United States Patent [19]

Klaus et al.

[11] 4,381,707

[45] May 3, 1983

[54] MECHANISM FOR LIFTING AND LOWERING AN IMPRESSION CYLINDER WITH SPRING-BIASED MULTIPLE DISC BRAKE LOCKING DEVICE

[75] Inventors: Peter Klaus, Tecklenburg; Jürgen Westerkamp, Lengerich, both of Fed. Rep. of Germany

[73] Assignee: Windmöller & Hölscher, Lengerich, Fed. Rep. of Germany

[21] Appl. No.: 329,327

[22] Filed: Dec. 10, 1981

[30] Foreign Application Priority Data

Dec. 12, 1980 [DE] Fed. Rep. of Germany ..... 3046989

[51] Int. Cl.[3] ..... B41F 3/58

[52] U.S. Cl. ..... 101/282

[58] Field of Search ..... 101/152, 153, 247, 182, 101/184, 185, 179, 158, 181, 180, 282; 100/170

[56] References Cited

U.S. PATENT DOCUMENTS

| | | | |
|---|---|---|---|
| 3,793,952 | 2/1974 | Neumann et al. | 101/247 X |
| 3,894,488 | 7/1975 | Gazzola | 101/153 |
| 4,046,070 | 9/1977 | Halley | 101/153 X |
| 4,057,012 | 11/1977 | Heidemman | 101/247 X |
| 4,119,031 | 10/1978 | Ottenhues | 101/247 X |

FOREIGN PATENT DOCUMENTS

| | | | |
|---|---|---|---|
| 2638750 | 3/1978 | Fed. Rep. of Germany | 101/282 |
| 2822531 | 11/1979 | Fed. Rep. of Germany | 101/153 |

*Primary Examiner*—E. H. Eickholt

*Attorney, Agent, or Firm*—Fleit, Jacobson & Cohn

[57] ABSTRACT

In a rotogravure printing press, the two journal bearings of the impression cylinder are each connected to a double acting piston-cylinder unit for lifting and lowering the impression cylinder and are interconnected by a synchronizing shaft which is mounted thereon and is provided with pinions engaging racks fixed with respect to the frame of the press. The synchronizing shaft can be coupled to the journal bearings by at least one spring-biassed multiple disc brake which is released when the impression cylinder executes a wide stroke for the purpose of cylinder replacement and during pressure application of the impression cylinder. The brake is actuatable for engagement at the end of a short stroke when pressure is withdrawn.

7 Claims, 7 Drawing Figures

MECHANISM FOR LIFTING AND LOWERING AN IMPRESSION CYLINDER WITH SPRING-BIASED MULTIPLE DISC BRAKE LOCKING DEVICE

The invention relates to an apparatus for applying and withdrawing pressure and, as is necessary for cylinder replacement, causing a wide stroke to be executed by an impression cylinder which acts on the plate cylinder of a rotogravure press and of which the two journal bearings are each connected to a double acting pressure cylinder for lifting and lowering the impression cylinder and are interconnected by a synchronising shaft which is mounted thereon and is provided with pinions engaging racks fixed with respect to the frame.

In an apparatus of this kind known from DE-PS No. 26 38 750, an entraining pin secured to one of the journal bearings engages with play at least corresponding to the pressure withdrawal stroke in a groove of a slide plate displaceable in the frame of the machine parallel to the journal bearings. The tappet of a switching valve secured on the slide plate is actuatable by the cam surface of a cam which is secured to the journal bearing and which is movable relatively to the switching valve by no more than the said play. To execute the wide-stroke movement and the movement for pressure application, the switching valve is bridged over whereas during the pressure withdrawal motion, pressure medium is supplied to the pressure cylinders by way of the switching valve in such a way that, at the end of the short-stroke pressure withdrawal motion, the switching valve blocks the supply of pressure medium to the operating chambers of the pressure cylinders. In the known apparatus, the pressure withdrawal motion is concluded when the switching valve blocks the throughflow of pressure medium or when the switching valve is in a condition of equilibrium between the weight of the impression cylinder, its bearings and the pistons of the lifting cylinders. It has now been found, however, that the switching valve is not adapted to hold the impression cylinder in an accurately defined position at the end of the pressure withdrawal motion because the full pressure of the pressure medium acts on it and, during pressure fluctuations and as a result of other disturbing influences, there could be a small amount of uncontrollable flow of pressure medium through the switching valve, so that the impression cylinder does not remain static in its inoperative position but hunts to and fro to an extent such that the switching valve alternately releases or blocks the throughflow of pressure medium. This unstable pressure withdrawal of the impression cylinder leads to different web tensions which might detrimentally influence the printing process.

It is therefore the problem of the invention to provide an apparatus of the aforementioned kind wherein the impression cylinder moved to the pressure withdrawal position remains blocked until the pressure applying motion is commenced.

According to the invention, this problem is solved in that the synchronising shaft can, for the purpose of blocking, be coupled to the journal bearings by at least one spring-biassed multiple disc brake and that the brake is released during execution of the wide stroke and during pressure application of the impression cylinder and is actuatable for engagement at the end of the short-stroke pressure withdrawal. The spring-biassed multiple disc brake is desirably actuatable by the pressure medium available in the system or it could also be operated by electric signals. Desirably, the spring-biassed multiple disc brake comprises a multiple disc clutch of which one half is secured to the journal bearings and the other half to the synchronising shaft. The multiple disc clutch may be engageable by a spring acting on the packet of discs and releasable by a piston which acts against the spring force and can have a pressure medium applied to it. Desirably, during the wide stroke and pressure application of the impression cylinder, the piston has the medium pressure of the pressure conduits acting on it. During these movements, the synchronising shaft is then freely rotatable. If, however, the pressure of the pressure medium should fail in the system, the impression cylinder is blocked in its position so that there will be no hard impact or undesired permanent application of the impression cylinder to the plate cylinder.

According to a preferred embodiment, a pressure medium-operated directional valve is provided which, on actuation of the directional valve effecting the short stroke pressure withdrawal motion, blocks the supply of pressure medium to the piston of the spring-biassed multiple disc brake with a delay corresponding to the pressure withdrawal stroke and relieves said piston. For the purpose of delayed switching over, the directional valve can have the pressure medium supplied to it by way of a throttle with an adjustable throttling cross-section.

One example of the invention will now be described in more detail with reference to the drawing, wherein.

Figure 1:
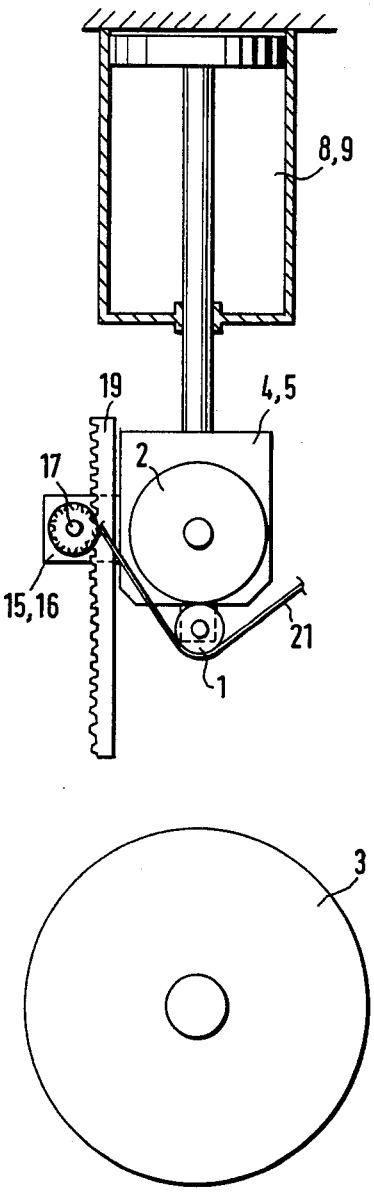
FIG. 1 is a diagrammatic side elevation of a rotogravure printing press of which the impression cylinder is in its raised position as a result of executing a wide stroke.
Figure 2:
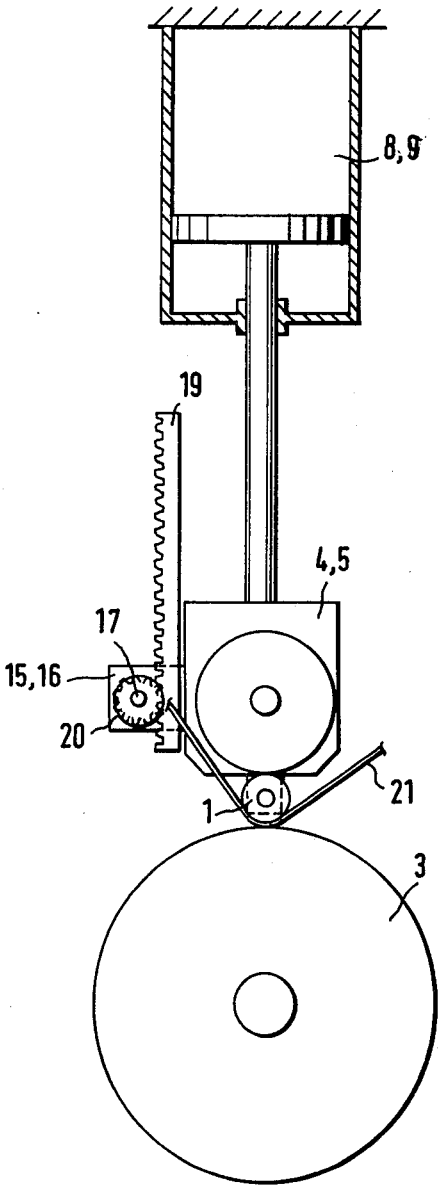
FIG. 2 is a view of a rotogravure press similar to FIG. 1, wherein the impression cylinder is in a pressure applying position.

An impression cylinder 1 is disposed between a pressure roller 2 and a plate cylinder 3 of a printing press. The impression cylinder 1 and the pressure roller 2 are mounted at their ends in journal bearings 4, 5 which are mounted for displacement radially to the plate cylinder 3 in guides 6 of the frame of the machine. The impression cylinder 1 comprises a bearing which is separate from but coupled to the pressure roller 2 and is independently displaceable. The impression cylinder is pressed against the pressure roller 2 by the plate cylinder 3 during pressure application movement. Each journal bearing 4, 5 is connected to the piston rod of fixed pressure cylinders 8, 9. Also connected to the journal bearings 4, 5 there are bearings 15, 16 of a synchronising shaft 17, pinions 18 being secured to both sides thereof for engaging fixed racks 19.

Figure 3:
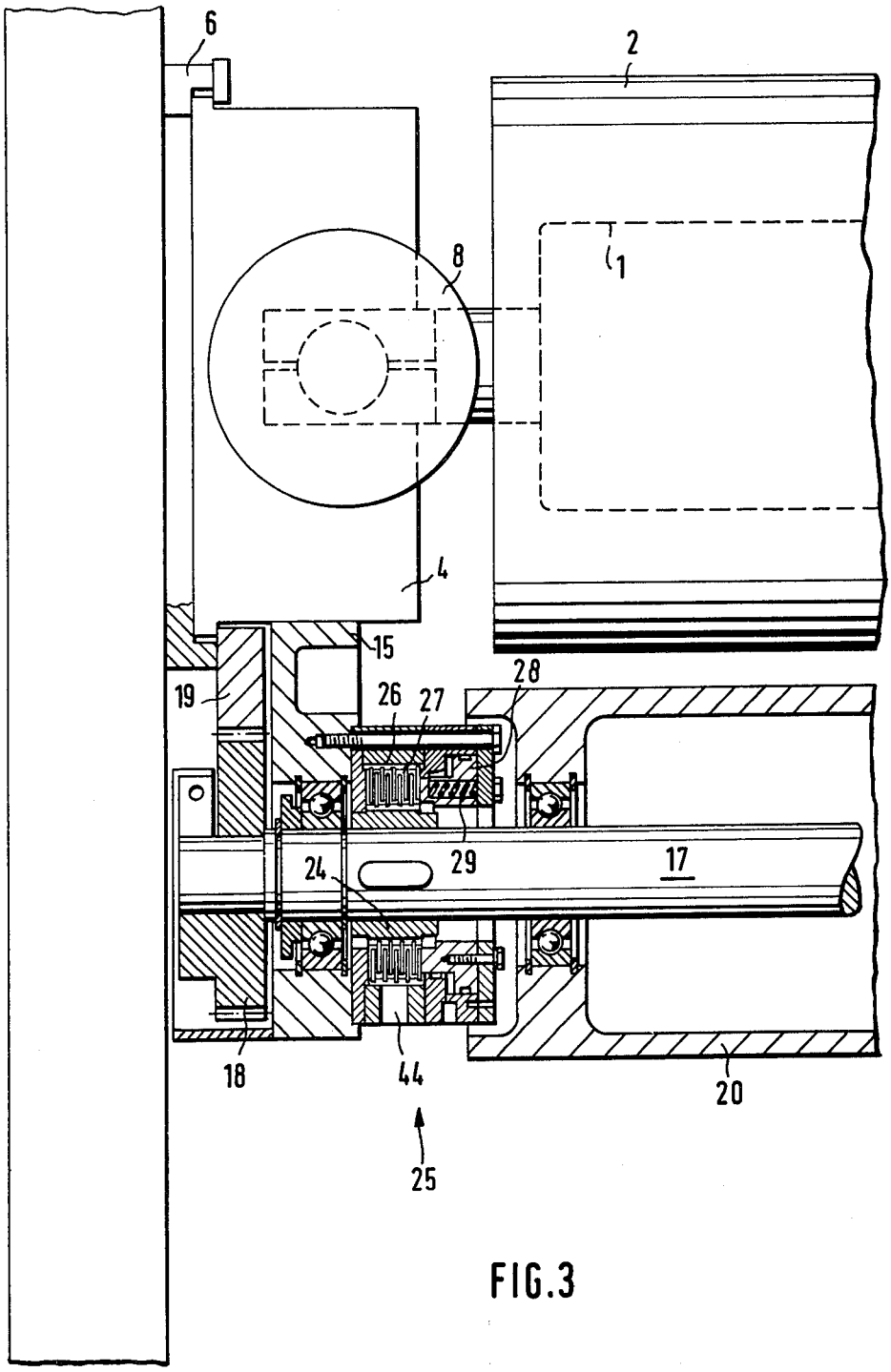
FIG. 3 is a part-sectional plan view of one side of the journal bearing and synchronising shaft.
Figure 4:
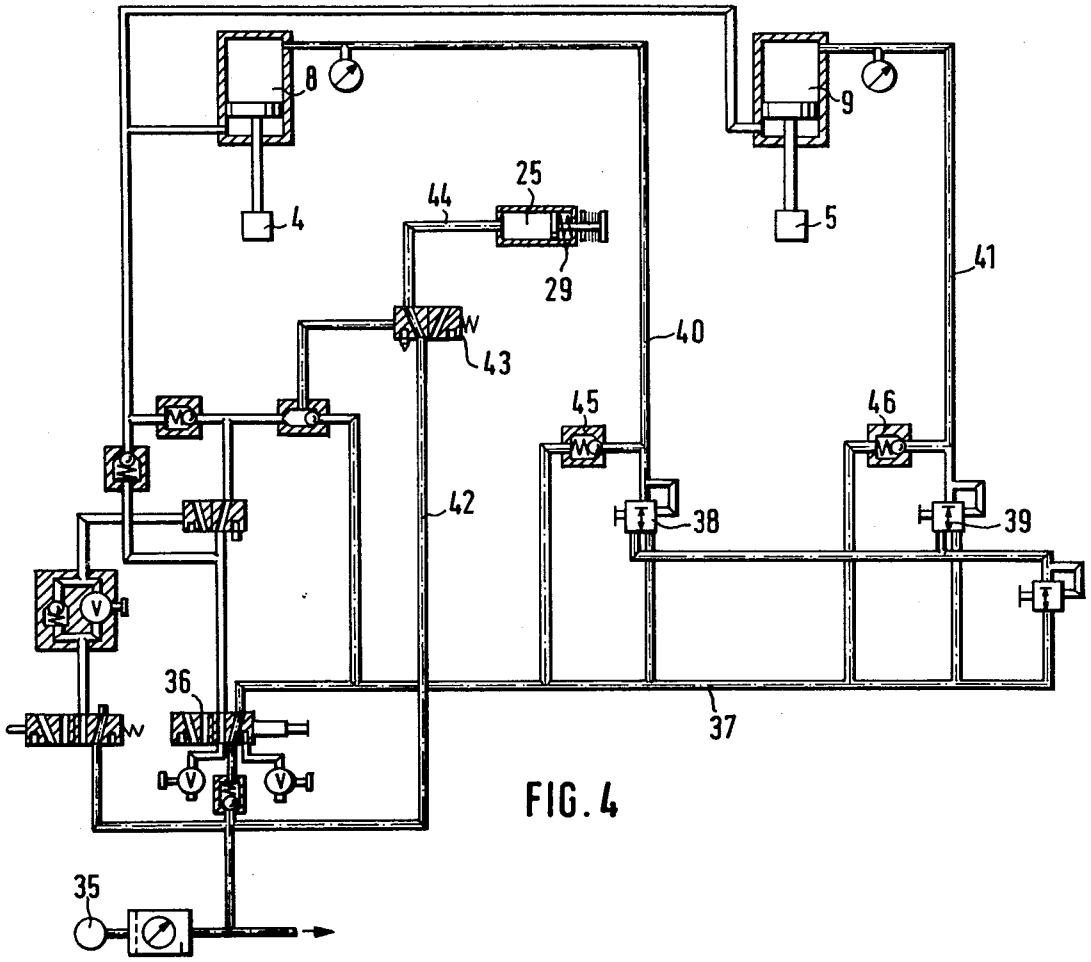
FIGS. 4 to 7 are circuit diagrams of the pressure medium for the different movements of the impression cylinder and pressure roller, with the corresponding positions of the directional valves and control slides.

A guide roller 20 loosely rotatable on the shaft 17 has the web 21 which is to be printed passed over it. Between the pinions 18 and racks 19 there is so much play that the impression cylinder 1 and pressure roller 2 could be slightly obliquely mounted with respect to the plate cylinder 3 without impeding the synchronising shaft 17. FIG. 3 shows only one half of the pressure roller 2. The internal portion 24 of a spring-biassed multiple disc brake 25 is secured to the synchronising shaft 17. The exterior part 26 of the spring-biassed multiple disc brake 25 is fixed to the bearing 15. A piston 28 coaxial with the discs 27 is pressed against the discs 27 by springs 28 and presses the discs 27 together. Pressure medium can be applied to the piston 28 through a conduit 44 so that the piston moves away from the discs 27 towards the right. In the unpressurised condition, therefore, the discs 27 are compressed so that a torque can be transmitted from the synchronising shaft 17 to the bearings 15, 16, i.e. rotation of the shaft 17 and movement of the journal bearing 4 are blocked. Upon actuating the piston 28 with pressure medium, movement of the impression cylinder 1 and pressure roller 2 is released. If the weight of the rollers 1, 2 makes it necessary, a further clutch 25 can also be arranged on the right-hand side (not shown) of the shaft 17.

The pneumatic circuit diagrams of FIGS. 4 to 7 show the different switching positions of the valves during the individual operating conditions. Pressure can be applied to the pressure cylinders 8, 9 from a pressure source 35 by way of a valve 36, a conduit 37 and fine regulating valves 38, 39 as well as conduits 40, 41, so that the cylinders 1, 2 move to a printing position. At the same time, the multiple disc clutch 25 is under pressure through the conduit 42 and valve 43 as well as conduit 44, so that rotary motion of the synchronising shaft 12 is released.

Figure 5:
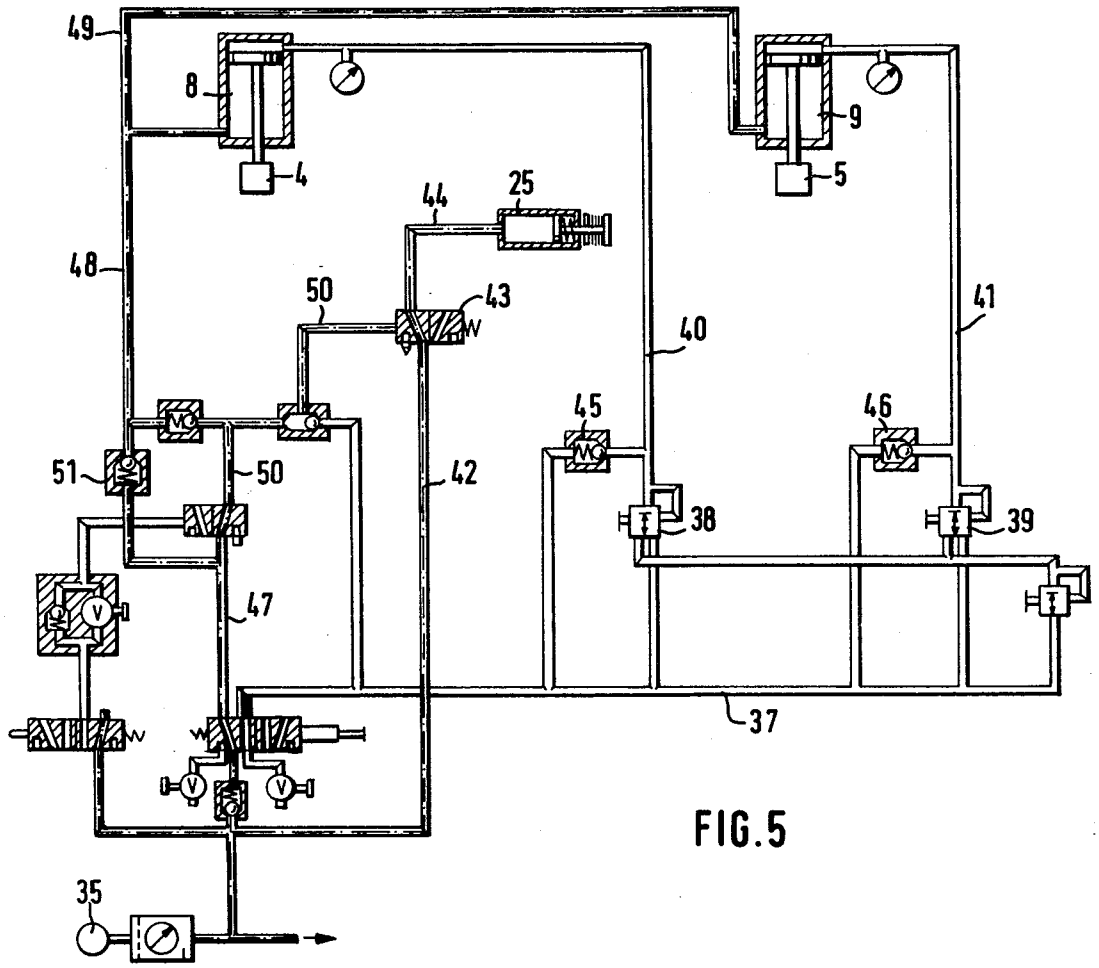

FIG. 5 shows the non-printing position. After switching over the valve 36, the conduits 37, 40, 41 are free from pressure. The pressure medium above the pistons of the pressure cylinders 8, 9 can flow off by way of check valves 45, 46. The conduits 47 to 50 are now under pressure so that the printing cylinders 1, 2 are lifted far off the plate cylinder 3. If 'pressure on' is reset as in FIG. 4, pressure medium in front of the pistons can flow off through the check valve 51.

Figure 6:
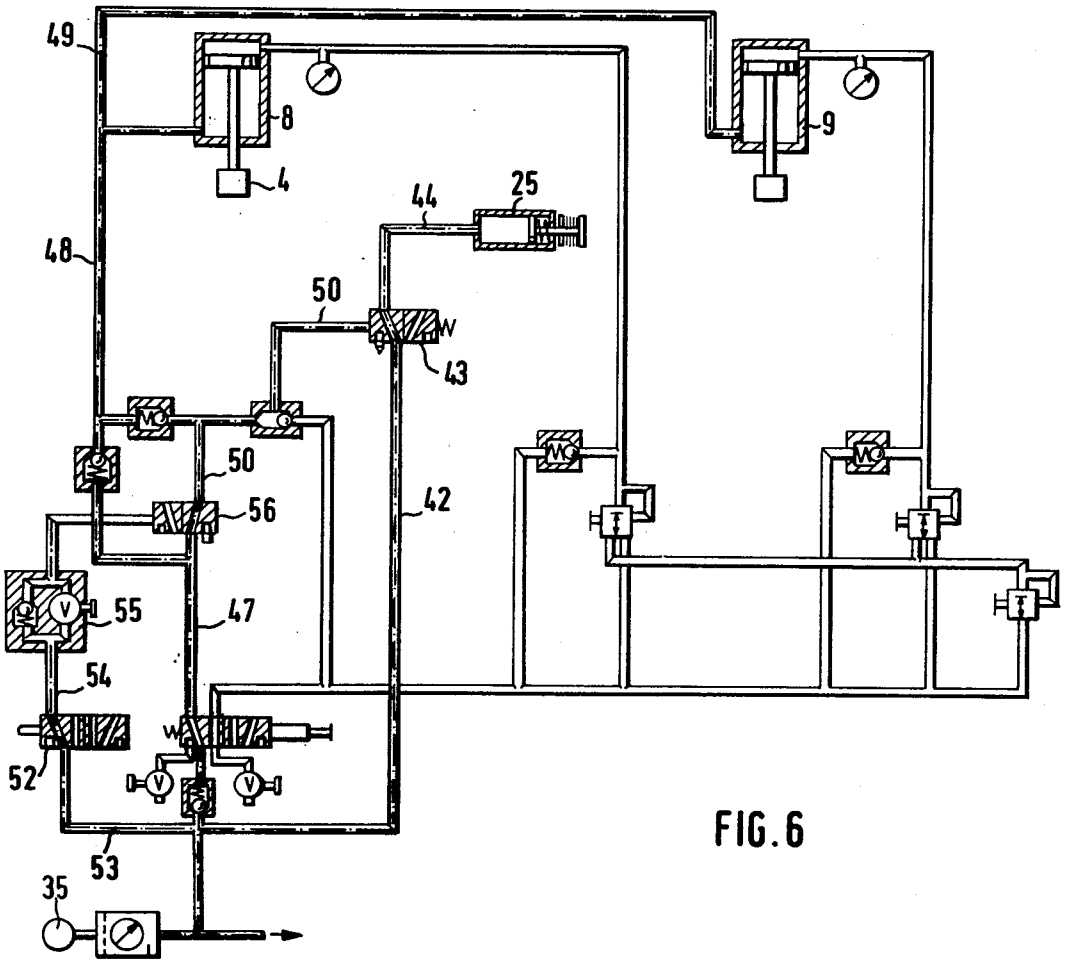

If 'pressure off' is demanded with a short stroke, a valve 52 must be actuated. Pressure medium will then flow through the conduits 53, 54 and a regulatable throttle 55 to a valve 56 which switches over with a delay corresponding to the slow supply of pressure medium. The switching over time can be set by regulating the throttle 55. FIG. 6 shows the valve 56 before switching over. Thus, pressure medium still flows from the conduit 47 through the valve 56 by way of the conduit 50 to the valve 43. The position of the valve 43 shown in FIG. 6 enables pressure medium to be available in front of the piston 28 of the clutch 25 and to hold the latter open by means of the pressure. After the valve 56 is switched over, the conduit 50 is free from pressure and the valve 43 moves to the left to its other position. The clutch 25 thereby also becomes free from pressure and the springs 29 block the synchronising shaft 17. By switching the valve 56 over, however, the conduits 48, 49 also become free from pressure so that the cylinders 8, 9 would have to drop. However, this is prevented by the spring-biassed multiple disc brake 25. Accordingly, the cylinders 1, 2 remain in the position they have reached as defined during 'pressure off short stroke'.

Figure 7:
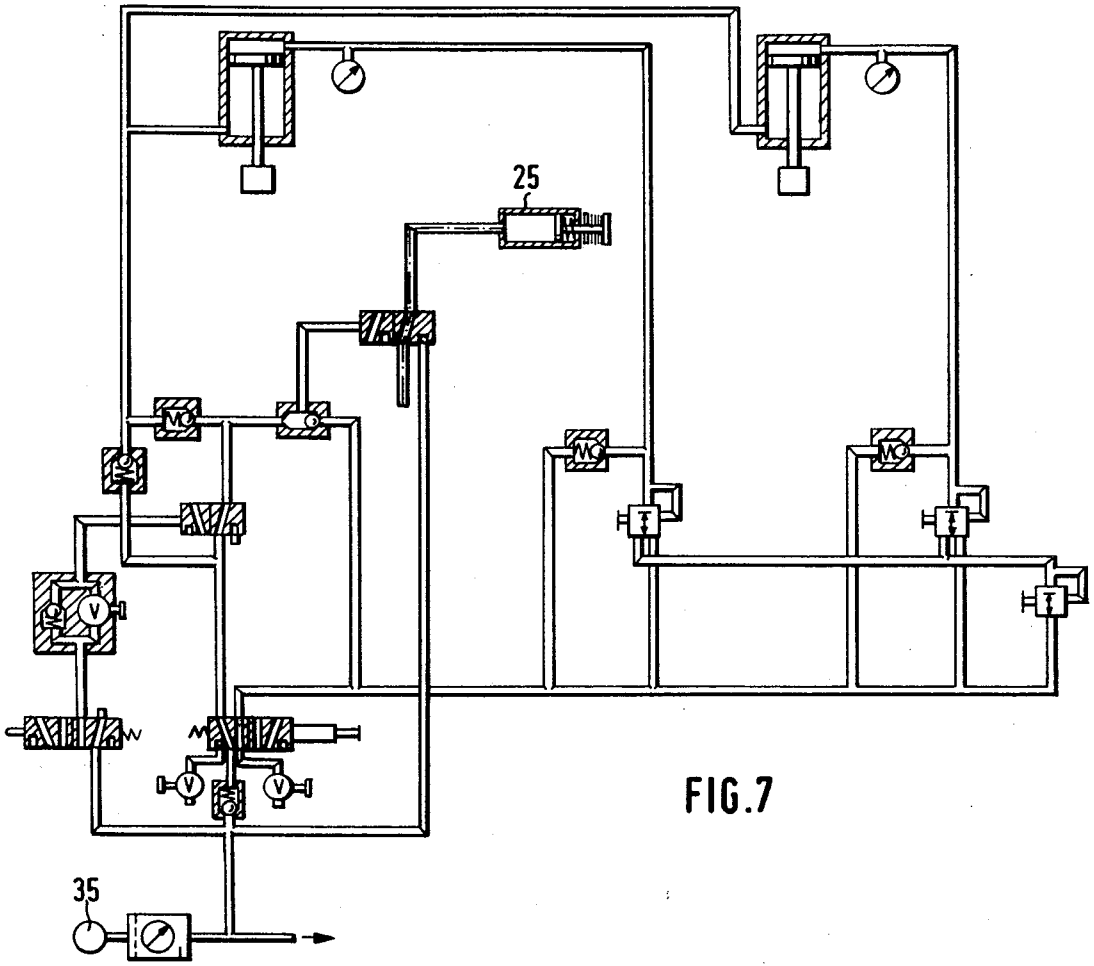

Even if the pressure in the pressure medium system is completely absent as is shown in FIG. 7, the cylinders 1, 2 remain in the position which they have reached. This also applies to the wide stroke position of FIG. 5. During prolonged inoperative periods, one thereby prevents damage to the cylinder lining of the impression cylinder through continuous pressure on the plate cylinder 3.

We claim:

1. Apparatus for applying and withdrawing pressure and, as is necessary for cylinder replacement, causing a wide stroke to be executed by an impression cylinder which acts on the plate cylinder of a rotogravure press and of which the two journal bearings are each connected to a double acting pressure cylinder for lifting and lowering the impression cylinder and are interconnected by a synchronising shaft which is mounted thereon and is provided with pinions engaging racks fixed with respect to the frame, characterised in that the synchronising shaft (17) can, for the purpose of blocking, be coupled to the journal bearings (4, 5) by at least one spring-biassed multiple disc brake (25), and that the brake (25) is released during execution of the wide stroke and during pressure application of the impression cylinder (1) and is actuatable for engagement at the end of the short-stroke pressure withdrawal.

2. Apparatus according to claim 1, characterised in that the spring-biassed multiple disc brake (25) is actuatable by pressure medium or electric switching signals.

3. Apparatus according to claim 1 or claim 2, characterised in that the spring-biassed multiple disc brake comprises a multiple disc clutch (25) of which one half is secured to the journal bearings (4, 5) and the other half to the synchronising shaft (17).

4. Apparatus according to claim 1, characterised in that the spring-biassed multiple disc brake (25) is engageable by a spring (29) acting on the packet of discs and can be released by a piston (28) which acts against the spring force and can have a pressure medium applied to it.

5. Apparatus according to claim 4, characterised in that, during the wide stroke and pressure application of the impression cylinder (1), the piston (28) has the medium pressure of the pressure conduits (47, 48, 49) acting on it.

6. Apparatus according to claim 5, characterised in that a pressure medium-operated directional valve (56) is provided which, on actuation of the directional valve (52) effecting the short stroke pressure withdrawal motion, blocks the supply of pressure medium to the piston (28) of the spring-biassed multiple disc brake (25) with a delay corresponding to the pressure withdrawal stroke and relieves said piston.

7. Apparatus according to claim 6, characterised in that, for the purpose of delayed switching over, the directional valve (56) can have the pressure medium supplied to it by way of a throttle (55) with an adjustable throttling cross-section.

* * * * *